US008201530B2

(12) United States Patent
Talan et al.

(10) Patent No.: US 8,201,530 B2
(45) Date of Patent: Jun. 19, 2012

(54) VALVE DRIVE OF AN INTERNAL COMBUSTION ENGINE

(75) Inventors: Georg Talan, Urbach (DE); Manfred Batzill, Neuhausen (DE); Dietmar Schwarzenthal, Ditzingen (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 354 days.

(21) Appl. No.: 12/543,115

(22) Filed: Aug. 18, 2009

(65) Prior Publication Data

US 2010/0126448 A1 May 27, 2010

(30) Foreign Application Priority Data

Nov. 27, 2008 (DE) ..... 10 2008 060 170

(51) Int. Cl.
*F01L 1/34* (2006.01)

(52) U.S. Cl. ..... 123/90.18

(58) Field of Classification Search ..... 123/90.15, 123/90.17, 90.18, 90.6, 90.21, 90.34, 90.31; 29/888.1; 74/567, 568 R
See application file for complete search history.

(56) References Cited

U.S. PATENT DOCUMENTS 7,409,938 B2 * 8/2008 Dengler ..... 123/90.18

FOREIGN PATENT DOCUMENTS

| | | | |
|---|---|---|---|
| DE | 101 48 178 | A1 | 4/2003 |
| DE | 10 2007 037232 | A1 | 2/2009 |
| DE | 10 2007 054978 | A1 | 5/2009 |
| DE | 10 2007 062234 | A1 | 6/2009 |
| EP | 0 798 451 | B1 | 4/1999 |

OTHER PUBLICATIONS

German Search Report, dated Nov. 24, 2009 (Appl. No. 10 2008 060 167.5).
German Search Report, dated Nov. 24, 2009 (Appl. No. 10 2008 060 170.5).

* cited by examiner

*Primary Examiner* — Thomas Denion
*Assistant Examiner* — Daniel Bernstein
(74) *Attorney, Agent, or Firm* — RatnerPrestia

(57) ABSTRACT

A valve drive of an internal combustion engine with a camshaft including cams for actuating gas-exchange valves, wherein at least one cam, comprising several cam faces, is guided nonrotatably but with freedom of axial movement on the camshaft, wherein a stroke profile, which cooperates with an actuating pin for the axial displacement of the cam, is assigned to the associated axially displaceable cam, and wherein the stroke profile of the axially displaceable cam in question comprises several stroke curves. A first stroke curve and a second stroke curve of the stroke profile are contoured both in the axial direction and in the radial direction such that the contour in the axial direction of the stroke profile of the camshaft is responsible for a defined axial displacement of the associated cam, and the contour in the radial direction of the stroke profile of the camshaft prevents the stroke curves from colliding.

7 Claims, 8 Drawing Sheets

VALVE DRIVE OF AN INTERNAL COMBUSTION ENGINE

CROSS REFERENCE TO RELATED APPLICATIONS

This U.S. patent application claims priority to German Application DE 10 2008 060 170.5, filed Nov. 27, 2008, which is incorporated by reference herein in its entirety.

FIELD OF THE INVENTION

The present invention pertains to a valve drive of an internal combustion engine.

BACKGROUND OF THE INVENTION

EP 0 798 451 B1 discloses a valve drive of an internal combustion engine with a camshaft, to which several cams, each of which actuates a gas exchange valve, are assigned. Each cam is supported nonrotatably on the camshaft but with the freedom to shift axially, wherein each cam comprises several cam faces arranged next to each other in the axial direction of the camshaft. Depending on the axial position of the cams on the camshaft, one of the cam faces of each cam is active and converts a rotational movement of the camshaft into stroking movements of a gas exchange valve. According to EP 0 798 451 B1, a stroke profile is formed on each of the two sides of each cam. An actuating pin cooperates with this profile to realize the axial displacement of each of the cams. By means of a stroke profile formed on the left side of a cam, the cam in question can be shifted axially to the left, and by means of a stroke profile formed on the right side of the cam, the cam in question can be shifted axially to the right. According to EP 0 798 451 B1, therefore, several stroke profiles and actuating pins are assigned to each cam to realize the ability to shift the cams along the camshaft.

A valve drive of an internal combustion engine, in which pairs of cams are combined into a cam piece so that they can be shifted jointly in the axial direction, is known from DE 101 48 178 A1. According to the prior art DE 101 48 178 A1, a stroke profile comprising intersecting stroke curves is assigned to the cam piece. An actuating pin cooperates with the stroke profile, which consists of two intersecting stroke curves, wherein, depending on which of the intersecting stroke curves of the stroke profile the actuating pin engages, the cam piece comprising several cams is shifted either axially to the left or axially to the right. By combining several cams into a cam piece, the number of stroke profiles can be reduced. Through the use of a stroke profile with intersecting stroke curves, the number of actuating pins required can be decreased.

When, in the case of the valve drive of DE 101 48 178 A1, an actuating pin travels through the area where the intersecting stroke curves intersect, the valve drive can malfunction, because there is the danger that the actuating pin can become jammed in the intersection area or, upon traveling through the intersection area, it can arrive in the area of the wrong stroke curve. This is disadvantageous. There is therefore a need for a valve drive by means of which such malfunctions can be reliably avoided and which at the same time makes it possible to reduce the number of actuating pins required.

Against this background, the present invention relates to the goal of creating a novel valve drive of an internal combustion engine. According to aspects to the invention, a first stroke curve and a second stroke curve of the stroke profile are contoured both in the axial direction of the stroke profile, i.e., of the camshaft, and also in the radial direction of the stroke profile, i.e., of the camshaft, in such a way that the contouring in the axial direction of the stroke profile, i.e., of the camshaft, is responsible for a defined axial displacement of the cam or cam piece in question, and the contouring in the radial direction of the stroke profile, i.e., of the camshaft, prevents the stroke curves from colliding. By means of the inventive valve drive, malfunctions can be reliably avoided while at the same time the number of actuating pins required can be reduced.

Preferred elaborations of the invention can be derived from the following description. Exemplary embodiments of the invention are explained on the basis of the drawing, but the invention is not to be considered limited to them.

DETAILED DESCRIPTION OF THE PREFERRED EMBODIMENTS

Figure 1:
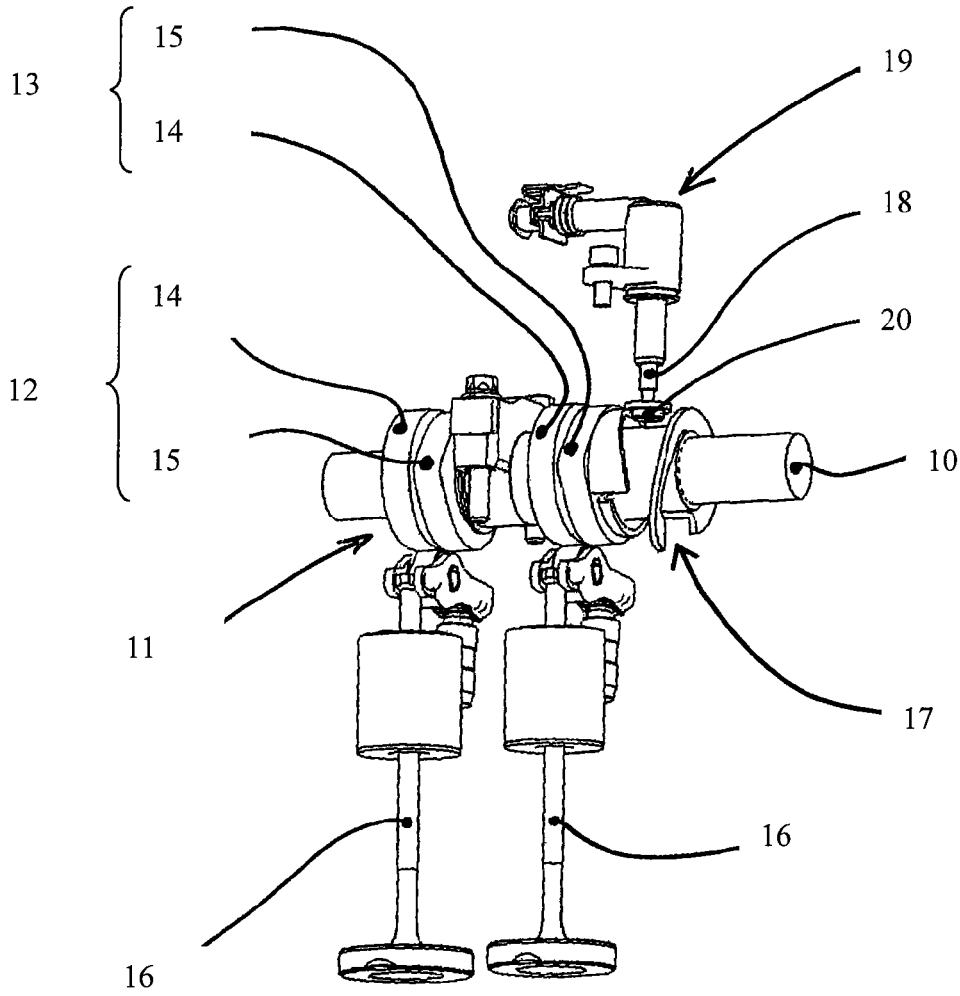
FIG. 1 shows a perspective view of part of an inventive valve drive of an internal combustion engine.
Figure 2:
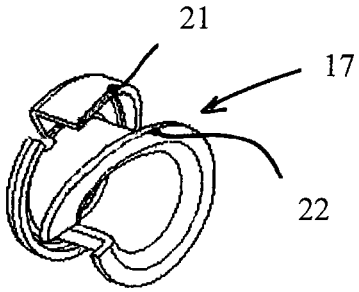
FIG. 2 shows a perspective view of a detail of FIG. 1.
Figure 3:
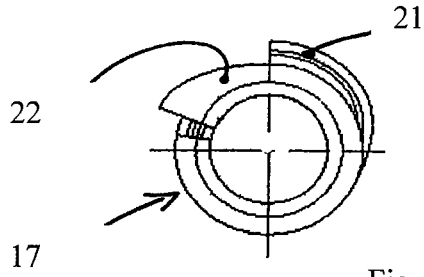
FIG. 3 shows a first side view of the detail of FIG. 2.
Figure 4A:
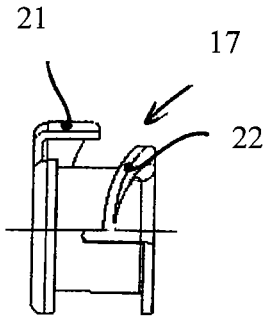
FIGS. 4*a*-4*c* show side views of the detail of FIG. 2 as compared with FIG. 3, each rotated by 90°.
Figure 4B:
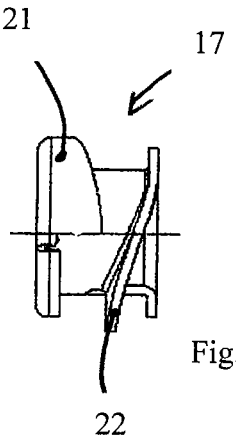
Figure 4C:
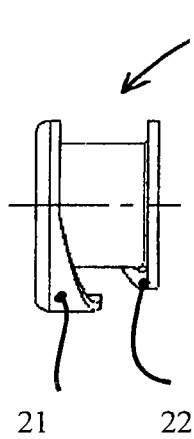
Figure 5:
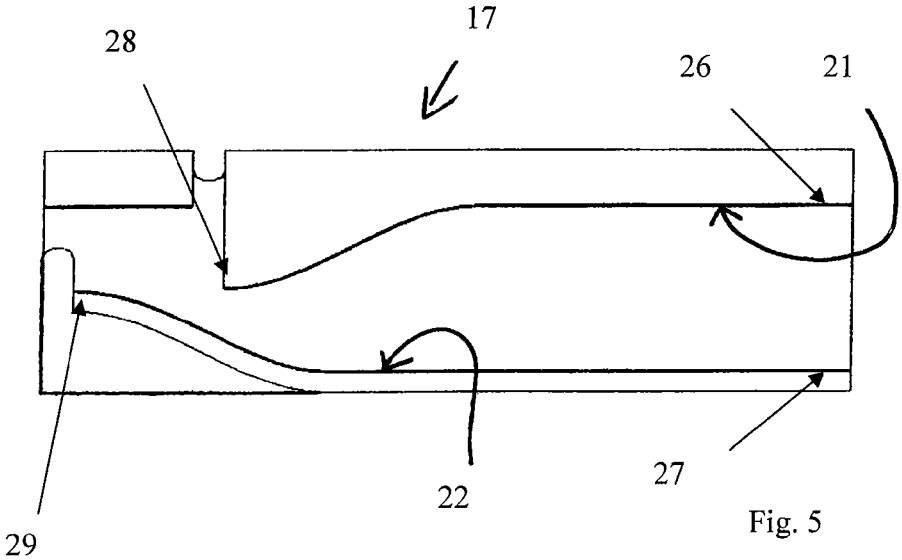
FIG. 5 shows a developed view of the detail of FIG. 2.

FIG. 1 shows part of an inventive valve drive of an internal combustion engine in the area of a cam piece 11, guided nonrotatably but with freedom of axial displacement on a camshaft 10, wherein the cam piece 11 comprises two cams 12, 13. Each cam 12, 13 of the axially displaceable cam piece 11 has, in the exemplary embodiment shown here, two cam faces 14, 15, which are positioned one behind the other, i.e., next to each other, in the axial direction of the camshaft 10.

Each cam 12, 13 serves to actuate a gas-exchange valve 16, wherein the cams 12, 13 convert a rotational movement of the camshaft 10 into a stroking movement of the associated gas-exchange valve 16. An amplitude and/or phase position of the stroking movements of the gas-exchange valves 16 depends on the axial position which the cam piece 11 assumes on the camshaft 10 and on which cam face 14 or 15 of the cams 12, 13 serves to actuate the associated gas-exchange valve 16.

According to FIG. 1, a stroke profile 17 is assigned to the cam piece 11, i.e., to one side of that cam piece. So that the cam piece 11 can be shifted axially, an actuating pin 18 cooperates with the stroke profile 17, wherein the actuating pin 18 can be pushed by an actuator 19 in the axial direction of the actuating pin 18 and thus in the radial direction of the camshaft 10. When the terminal section 20 of the actuating pin 18 engages in the stroke profile 17 and the camshaft 10 is rotated, the cam piece 11 is displaced in the axial direction of the camshaft 10.

The stroke profile 17 of the inventive valve drive assigned to the cam piece 11 has two stroke curves 21, 22. One of the stroke curves, namely, the stroke curve 21 in the exemplary embodiment shown here, cooperates with the actuating pin 18 to displace the cam piece 11 to the left, whereas another stroke curve, namely, the stroke curve 22 in the exemplary embodiment shown here, serves to displace the cam piece 11 to the right.

In accordance with the present invention, the two stroke curves 21, 22 of the stroke profile 17 are contoured both in the axial direction 23 (see FIG. 6*a*) of the camshaft 10, i.e. of the stroke profile 17, and in the radial direction 24 (see FIG. 6*a*) of the camshaft 10, i.e., of the stroke profile 17.

The contouring of the stroke curves 21, 22 in the axial direction of the camshaft 10, i.e., of the stroke profile 17, makes it possible to realize a defined axial displacement of the cam piece 11. The contouring of the stroke curves 21, 22 in the radial direction 24 of the camshaft 10, i.e., of the stroke profile 17, prevents the stroke curves 21, 22 from colliding.

The inventive contouring of the stroke curves 21, 22 in the axial direction 23 and in the radial direction 24 of the camshaft 10, i.e., of the stroke profile 17, will be explained in detail below by reference to FIGS. 6*a*-6*f*, wherein FIGS. 6*a*, 6*b*, and 6*c* visualize the cooperation of the terminal section 20 of the actuating pin 18 with the stroke curve 21, and FIGS. 6*d*, 6*e*, and 6*f* visualize the cooperation of the terminal section 20 of the actuating pin 18 with the stroke curve 22.

Figure 6A:
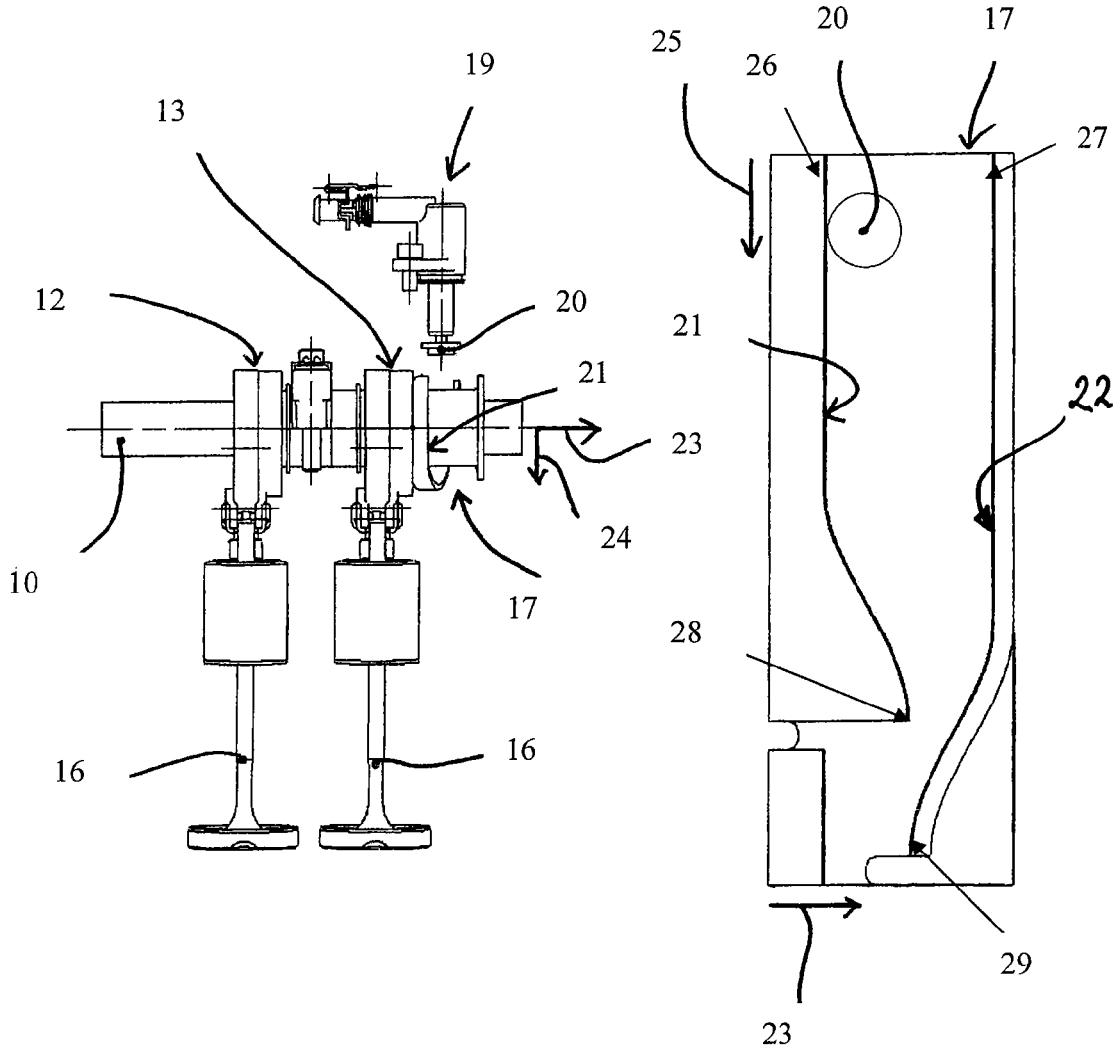
FIGS. 6*a*-6*f* show the valve drive of FIG. 1 together with a developed view of the detail of FIG. 2 in various states.
Figure 6B:
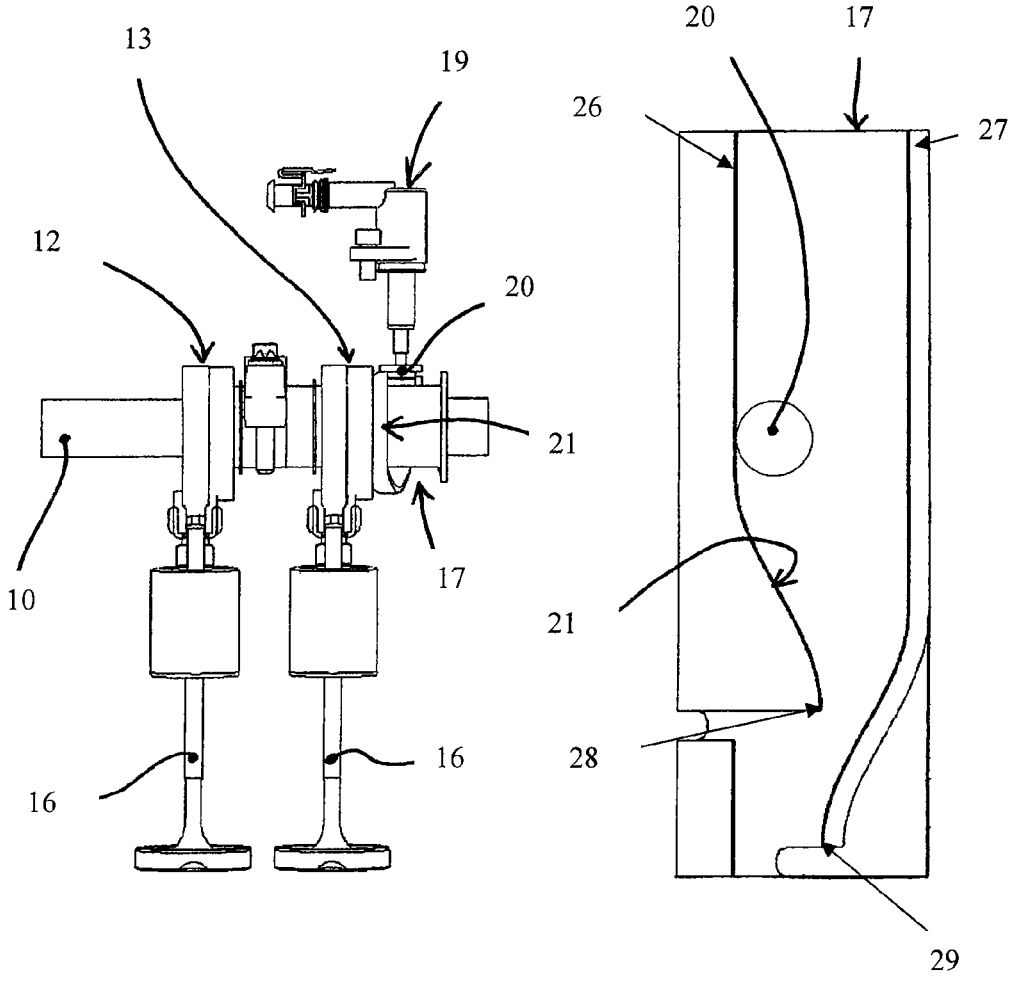
Figure 6C:
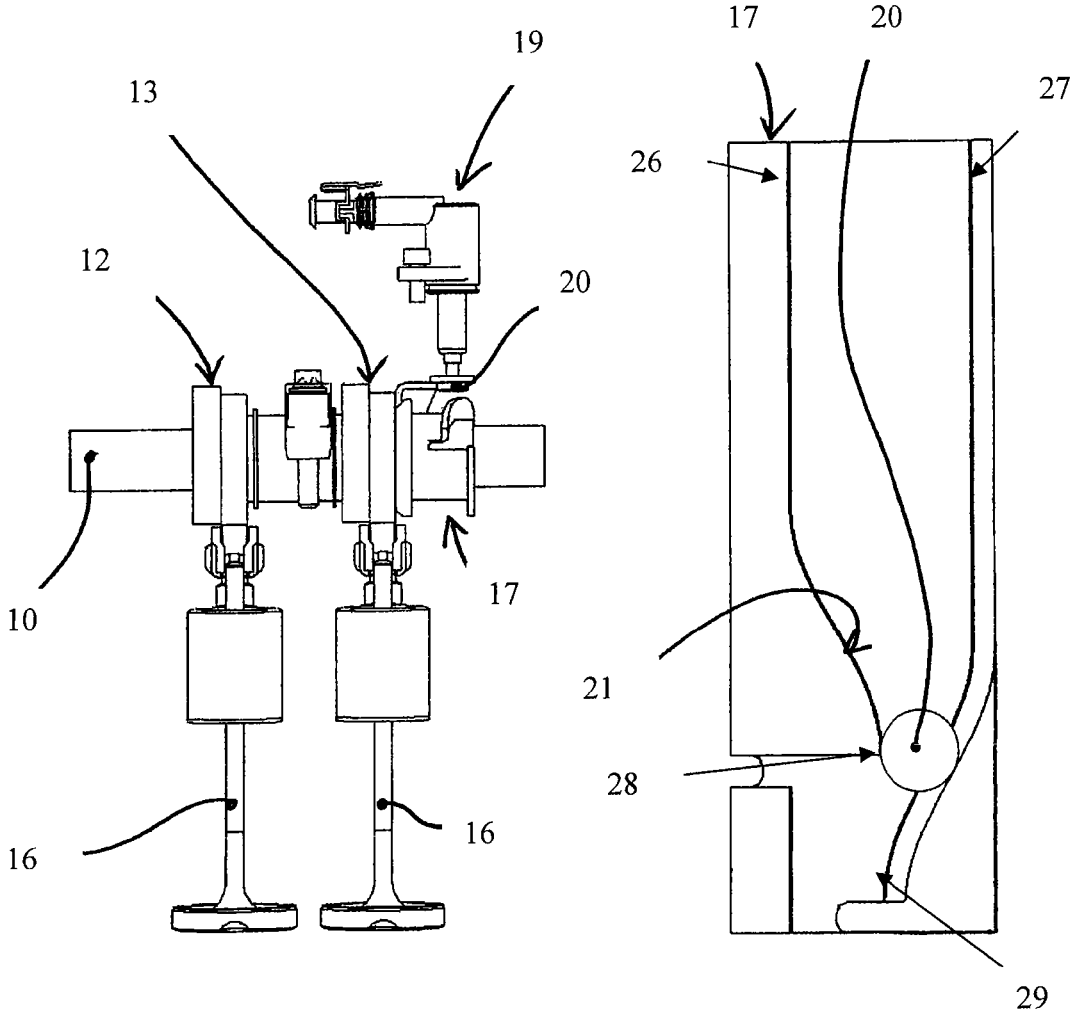
Figure 6D:
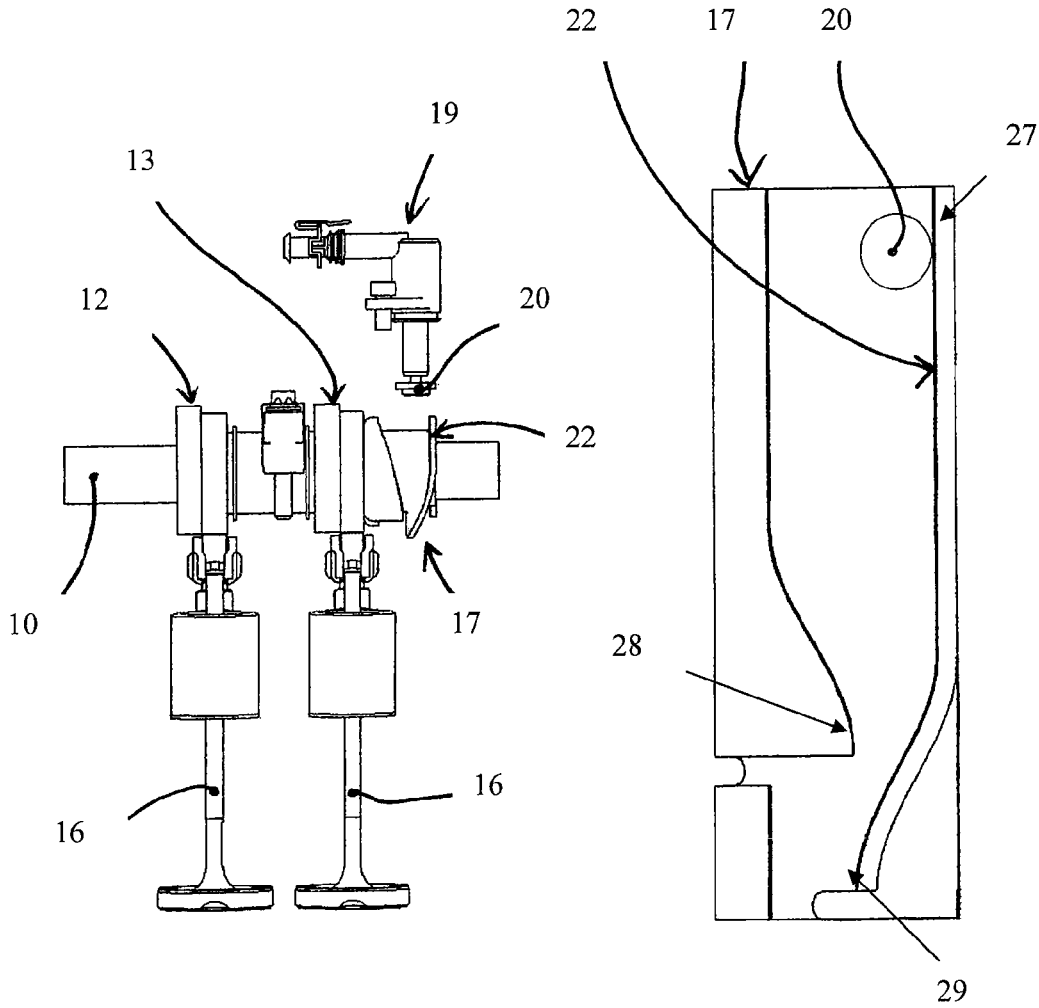

In FIGS. 6*a* and 6*d*, the terminal section 20 and thus the actuating pin 18 are located, looking in the radial direction 24 of the camshaft 10, in a radially outward-retracted rest position, wherein, so that the terminal section 20 of the actuating pin 18 can be introduced into the stroke profile 17, the actuating pin 18 and thus the terminal section 20 of the pin are pushed by the actuator 19 radially inward onto the stroke profile.

In FIGS. 6*a* and 6*d*, the stroke profile is aligned with the actuating pin 18 in such a way that the terminal section 20 of the actuating pin 18 can be introduced into the proper area 26, 27 of the associated stroke curve 21, 22 of the stroke profile 17, i.e., into the area provided for the entry of the actuating pin 18. These entry areas 26, 27 of the stroke curves 21, 22 for the actuating pin 18 correspond to initial areas of the stroke curves 21, 22, i.e., initial in the sense of coming first in the circumferential direction 25 (see the arrow in FIG. 6*a*) of the stroke profile 17, i.e., of the camshaft 10.

The entry areas 26, 27 of the stroke curves 21, 22 of the stroke profile 17 are located, looking in the circumferential direction 25 of the stroke profile 17, approximately in the same position, namely, at the upper end of the developed views of the stroke profile 17 shown on the right of FIGS. 6*a*-6*f*. The entry areas 26, 27 of the stroke curves 21, 22 of the stroke profile 17 for the actuating pin 18 and thus the initial areas of the stroke curves 21, 22 are located, looking in the axial direction 23 of the stroke profile 17, i.e., of the camshaft 10, a certain distance apart but lie in approximately the same position looking in the radial direction 24 of the stroke profile 17, i.e., of the camshaft 10.

Figure 6E:
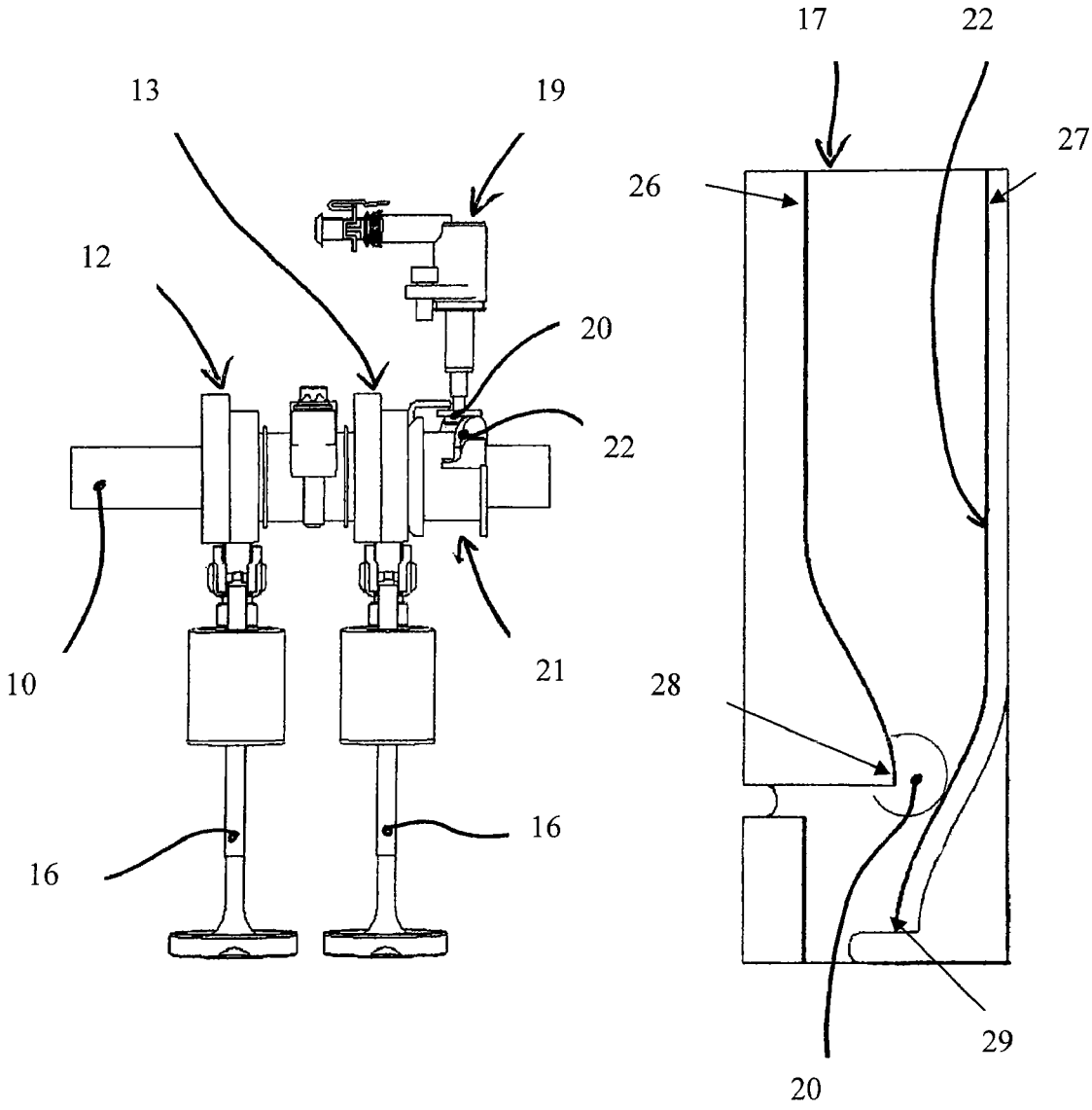
Figure 6F:
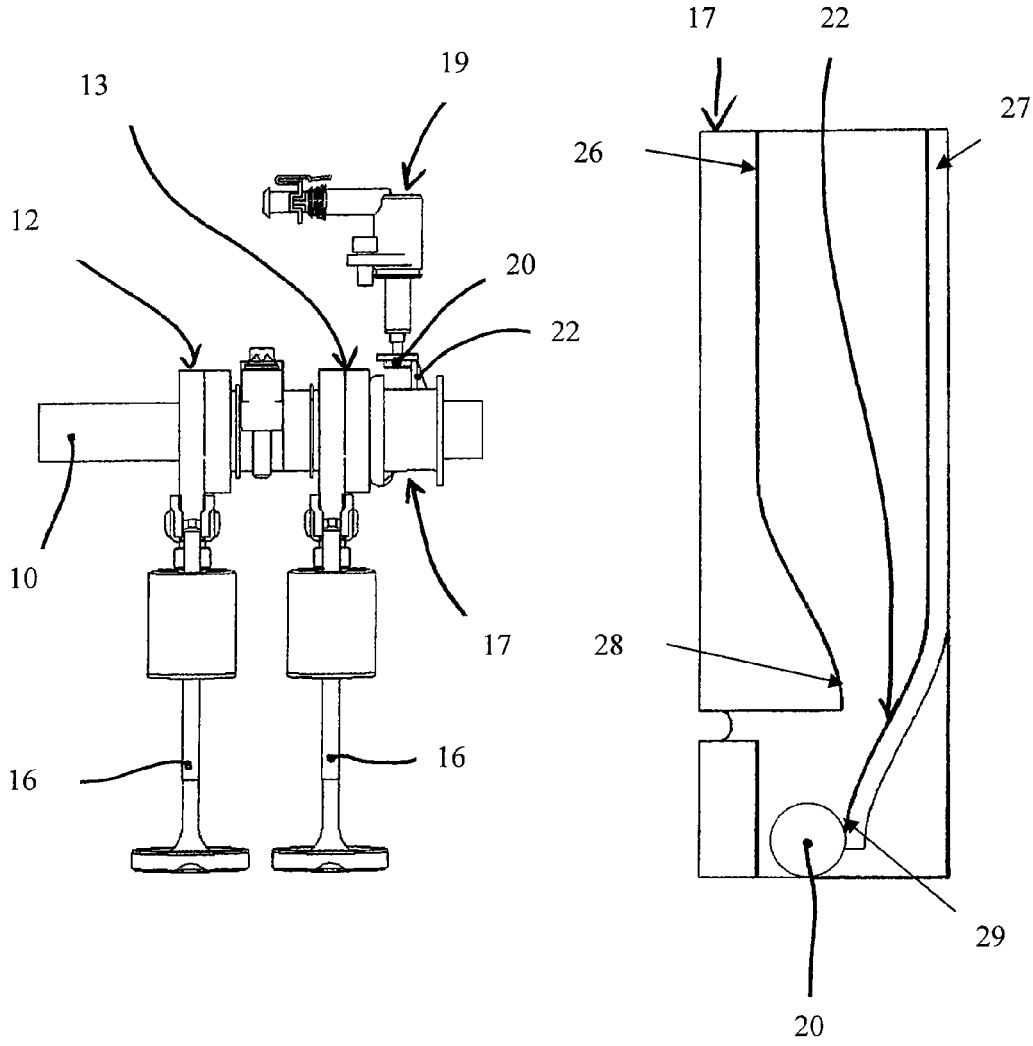

FIGS. 6*c* and 6*f* show the stroke profile 17 and the terminal section 20 of the actuating pin 18 in relative positions in which, in FIG. 6*c*, the terminal section 20 is located in the area of a exit area 28 of the stroke curve 21 and, in FIG. 6*f*, in the area of an exit area 29 of the stroke curve 22 for the actuating pin 18. It can be seen from the figures that the exit area 28, i.e., the terminal area of the stroke curve 21 (see FIG. 6*c*), and the exit area 29, i.e., the terminal area of the stroke curve 22 (see FIG. 6*f*), are a certain distance away from each other in the circumferential direction 25 of the stroke profile 17, i.e., of the camshaft 10. Looking in the axial direction 23 and also in the radial direction 24, however, the exit areas 28, 29, i.e., the terminal areas of the two stroke curves 21, 22, are located in approximately the same position.

In FIG. 6*b*, in which the terminal section 20 of the actuating pin 18 cooperates with the stroke curve 21, a relative position between the stroke profile 17 and the actuating pin 18 is shown in which the terminal section 20 rests on a section of the stroke curve 21 which is located between the entry area 26 and the exit area 28 of the stroke curve 21. In FIG. 6*e*, in which the terminal section 20 of the actuating pin 18 is cooperating with the stroke curve 22 of the stroke profile 17, a relative position between the stroke profile 17 and the actuating pin 18 is shown in which the terminal section 20 rests on a section of the stroke curve 22 which, looking in the circumferential direction 25 of the stroke profile 17, is located between the entry area 27 and the exit area 29 of the stroke curve 22.

The exit area 28, i.e., the terminal area of the stroke curve 21, which, looking from the entry area 26 of that curve in the circumferential direction 25 of the stroke profile 17, is located before the exit area 29 of the stroke curve 22, lies, as shown in FIG. 6*e*, above the part of the stroke curve 22 located in the same corresponding circumferential position, i.e., above with respect to the radial direction 24 of the camshaft 10, i.e., of the stroke profile 17. This serves to avoid a collision between the two stroke curves 21, 22.

When the actuating pin 18 has been moved into the exit area 28 of the stroke curve 21 (FIG. 6*c*) or into the exit area 29 of the stroke curve 22 (FIG. 6*f*) by the corresponding rotation of the camshaft 10, the actuating pin 18 and thus the terminal section 20 of the pin are shifted radially outward from the corresponding radial position which they assume in the entry area 26, 27, namely, in such a way that the actuating pin 18 then automatically returns to the starting positions shown in FIGS. 6*a* and 6*d*.

While preferred embodiments of the invention have been described herein, it will be understood that such embodiments are provided by way of example only. Numerous variations, changes and substitutions will occur to those skilled in the art without departing from the spirit of the invention. It is intended that the appended claims cover all such variations as fall within the spirit and scope of the invention.

LIST OF REFERENCE NUMBERS

10 camshaft
11 cam piece
12 cam
13 cam
14 cam face
15 cam face
16 gas-exchange valve
17 stroke profile
18 actuating pin
19 actuator
20 terminal section
21 stroke curve
22 stroke curve
23 axial direction
24 radial direction
25 circumferential direction
26 entry area
27 entry area
28 exit area
29 exit area

The invention claimed is:

1. A valve drive for an internal combustion engine including a camshaft comprising cams for actuating gas-exchange valves, at least one axially displaceable cam, which comprises several cam faces, is guided nonrotatably but with freedom of axial movement on the camshaft, a stroke profile, which cooperates with an actuating pin for the axial displacement of the cam or cam piece, is assigned to said at least one axially displaceable cam or an axially displaceable cam piece comprising several cams, and said stroke profile of said axially displaceable cam or said cam piece comprises several stroke curves, a first stroke curve and a second stroke curve of the stroke profile are contoured both in an axial direction and in a radial direction such that a contour in an axial direction of the stroke profile of the cam shaft is responsible for a defined axial displacement of said at least one axially displaceable cam or cam piece and the contour in a radial direction of the stroke profile of the cam shaft prevents the first and second stroke curves from colliding, and either the axially displaceable cam or the cam piece is a sleeve including a single channel in which the actuating pin is positioned, the first stroke curve is a shoulder of the sleeve that extends from one end of the channel toward the second stroke curve, and the second stroke curve is another shoulder of the sleeve that extends from an opposing end of the channel toward the first stroke curve.

2. A valve drive according to claim 1, wherein entry areas of the first and second stroke curves of the stroke profile for the actuating pin and initial areas of the stroke curves of the stroke profile are located approximately in the same position in a circumferential direction of the stroke profile of the camshaft.

3. A valve drive according to claim 2, wherein the entry areas of the first and second stroke curves of the stroke profile are disposed a pre-determined distance away from each other in the axial direction of the stroke profile of the camshaft, and are in approximately the same position in the radial direction of the stroke profile of the camshaft.

4. A valve drive according to claim 1, wherein exit areas of the first and second stroke curves of the stroke profile for the actuating pin and the terminal areas of the stroke curves of the stroke profile are disposed a pre-determined distance from each other in a circumferential direction of the stroke profile of the camshaft.

5. A valve drive according to claim 4, wherein the exit areas of the first and second stroke curves of the stroke profile are in approximately the same position in the axial direction of the stroke profile of the camshaft, and also in the radial direction of the stroke profile of the camshaft.

6. A valve drive according to claim 4, wherein, as viewed from an entry area in the circumferential direction of the stroke profile of the camshaft, the exit area of the first stroke curve is located before the exit area of the second stroke curve and lies radially above the part of the second stroke curve located in the same circumferential position thereof.

7. A valve drive according to claim 1, wherein each stroke curve is defined by a single surface of the sleeve.

* * * * *